US005743227A

United States Patent [19]

Jacquet et al.

[11] Patent Number: 5,743,227

[45] Date of Patent: Apr. 28, 1998

[54] METHOD AND DEVICE FOR STOPPING THE STARTER OF A MOTOR VEHICLE ONCE THE ENGINE OF THE VEHICLE HAS STARTED

[75] Inventors: René Jacquet, Lyons; Bruno Lefebvre, Villeurbanne; Gérard Vilou, Tassin, all of France

[73] Assignee: Valeo Equipments Electriques Moteur, Creteil, France

[21] Appl. No.: 807,132

[22] Filed: Feb. 27, 1997

[30] Foreign Application Priority Data

Feb. 28, 1996 [FR] France ..... 96 02464

[51] Int. Cl.[6] ..... F02N 11/08

[52] U.S. Cl. ..... 123/179.3; 290/38 R

[58] Field of Search ..... 123/179.3, 179.4, 123/179.2; 290/38 R, 38 C

[56] References Cited

U.S. PATENT DOCUMENTS 4,198,945 4/1980 Eyermann et al. ..... 123/179.3

4,947,051 8/1990 Yamamoto et al. ..... 123/179.3

FOREIGN PATENT DOCUMENTS 2393165 12/1978 France .

2626417 7/1989 France .

*Primary Examiner*—Andrew M. Dolinar

*Attorney, Agent, or Firm*—McCormick, Paulding & Huber

[57] ABSTRACT

A starter for a motor vehicle engine is equipped with a device for cutting off the operation of the starter as soon as the engine is running by itself. The device detects the voltage or current waves in the power supply to the starter, and stops the starter when these waves disappear. At each new wave in the power supply signal, a monitoring period is generated, having a duration which decreases as the frequency of the waves increases, the starter being stopped when no new wave is detected in the last monitoring period.

9 Claims, 4 Drawing Sheets

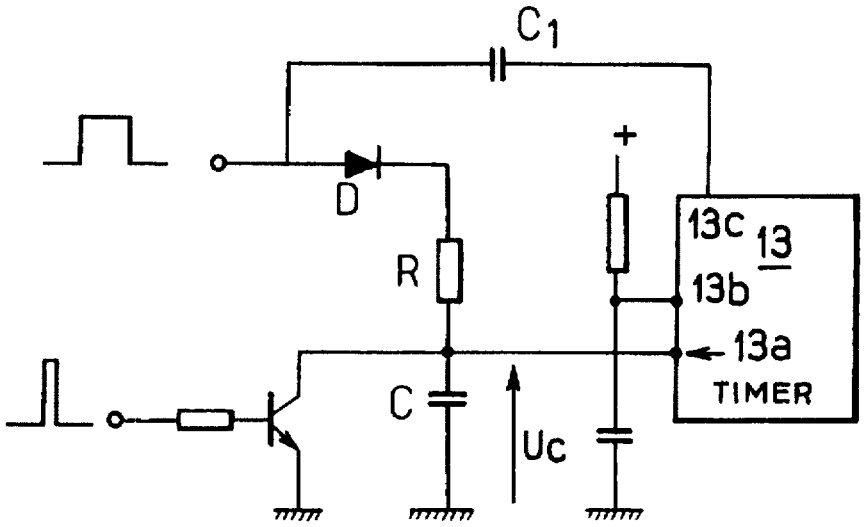
FIG. 4
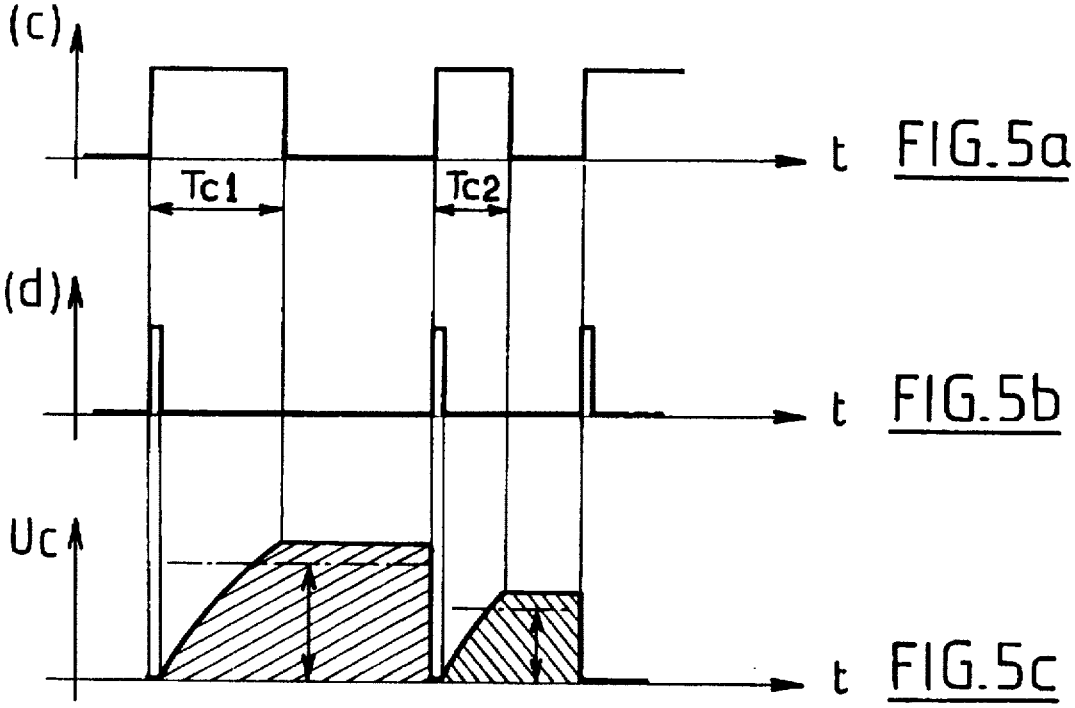
FIG. 5a
FIG. 5b
FIG. 5c

METHOD AND DEVICE FOR STOPPING THE STARTER OF A MOTOR VEHICLE ONCE THE ENGINE OF THE VEHICLE HAS STARTED

FIELD OF THE INVENTION

The present invention relates to a method and apparatus for stopping (cutting out, cutting off) a motor vehicle starter once the engine of the vehicle has been started.

BACKGROUND OF THE INVENTION

It is common practice to terminate the driving of the engine of a vehicle by the starter under the control of the driver of the vehicle. To this end, the driver releases the ignition key once the engine is producing the sounds characteristic of an engine running of its own accord. However, automobile and other motor vehicle engines are being made to be more and more silent, and this tendency makes it increasingly difficult for the driver to be able to detect when the starting operation has been successfully completed. It is therefore common for the starter to be driven by the engine after the latter has started and before the ignition key is released. This gives rise to the imposition of very severe forces on the starter.

Many devices for stopping a motor vehicle starter once the engine has itself started and is running by itself to an extent sufficient to have reached its slow running mode, are known. In particular, French patent specification FR 2 626 417 discloses control of starter cut-off when the frequency of the waves in the voltage across the starter, or of the current intensity flowing through the starter, goes above a given threshold value. These waves, consisting of variations in amplitude in the voltage or current of the power supply to the starter, are characteristic of the operation of starting the engine. That arrangement makes use of the feature whereby the frequency of these waves, which correspond to successive compression cycles of the engine, increases with time. It does not, however, enable the starter to be cut out immediately after the engine has properly started.

In practice, obtaining a measurement of frequency of the waves in the power supply signal presupposes that the signal can be analysed in a window of time which is long enough. As a result, when the threshold frequency is reached, the command to stop the starter is delayed until the end of the first time window in which it is possible to measure a frequency greater than the threshold value of the frequency.

In addition, the effective starting speed of the engine is a function of many parameters, and in particular the state of wear of the engine components, the characteristics of the fuel injection system and the ignition system, or even ambient temperature. In order not to run the risk, in certain cases, of prematurely stopping the starter, the engine speed threshold value, beyond which the starter is cut off, is generally very much higher than the effective engine speed at which the engine begins to operate of its own accord. It follows from this that, in the majority of cases, the starter is in operation far longer than necessary.

French patent specification No. FR 2 393 165, again, discloses a control device for a starter which cuts off the latter when the voltage or current waves in its power supply disappear. For this purpose, the voltage or current signal is carried along two paths, on one of which it is retarded. These two paths are at different levels so long as the waves exist. When the waves disappear, the two paths are then at the same level, and the device stops the starter. However, with such an arrangement, the command to stop the starter takes place, in relation to the inception of autonomous running of the engine, after a delay time which corresponds to the delay in the second of the said paths.

DISCUSSION OF THE INVENTION

One object of the invention is to propose a method and a device which enables a motor vehicle starter to be stopped once the engine of the vehicle has reached its threshold value for autonomous running of the engine, and which enables the period during which the starter is operating to be reduced systematically to a value which is only just long enough. This leads to improvement in convenience and comfort for the user, and can enable the starter itself to be simplified by omitting its free-wheel function.

According to the invention in a first aspect, a method for controlling cut-off of a motor vehicle starter, in which waves are detected in a signal corresponding to either the power supply voltage of the said starter or the intensity of the current flowing through it, and in which the starter is cut off when the said waves disappear, is characterised in that a monitoring period is generated for each new wave, the monitoring period having a duration which decreases as the frequency of the said waves increases, and in that the starter is cut off when no new wave is detected in the last monitoring period.

According to the invention in a second aspect, a device for controlling cut-off of a motor vehicle starter, comprising means for detecting waves in a signal corresponding to either the power supply voltage of the said starter or the intensity of current passing through it, together with means for commanding the cut-off of the starter when the said waves disappear, is characterised in that the said device includes means for generating, at each new wave, a monitoring period having a duration which decreases as the frequency of the said waves increases, and in that the means for cutting off the starter stop the latter when no new wave is detected in the last monitoring period.

According to a preferred feature of the invention, the means for detecting the said waves comprise means for generating, at each new wave, a zeroing pulse for returning the monitoring period to zero.

In that case, the device preferably includes processing means for converting the waves of the said signal into a rectangular signal of constant amplitude having the same period as the said waves, the monitoring period then being a function of the duration of an elementary pulse of the said rectangular signal.

With such an arrangement, the device preferably includes a timer having a voltage controlled time period, the control input of the timer being controlled by the voltage of a capacitor which is supplied with the said rectangular signal, the device then further including means for discharging the said capacitor at each zeroing pulse.

The device then preferably further includes a counter which is reset on each new zeroing pulse, the duration of the monitoring period being a function of the value of the said counter at each new pulse.

Preferably, the device then further includes a reverse counter which is reset to a value which is a function of the value of the counter on receipt by the latter of each new zeroing pulse.

According to a further preferred feature of the invention, the counter and the reverse counter are controlled by a common signal from a clock timer, the value at which the reverse counter is set being selected so as to be greater than the value of the counter.

Preferably, at each zeroing pulse, the reverse counter is reset before the counter is reset.

Further features and advantages of the invention will appear more clearly on a reading of the following detailed description of some preferred embodiments of the invention, which is given by way of non-limiting example only and with reference to the accompanying drawings.

BRIEF DESCRIPTION OF THE DRAWINGS

FIG. 4 is a diagram which illustrates one possible embodiment of the timer, with a variable timing period, in the control means of FIG. 2.

FIGS. 5*a* to 5*c* show various control signals from the timer shown in FIG. 4.

DESCRIPTION OF PREFERRED EMBODIMENTS OF THE INVENTION

Figure 1:
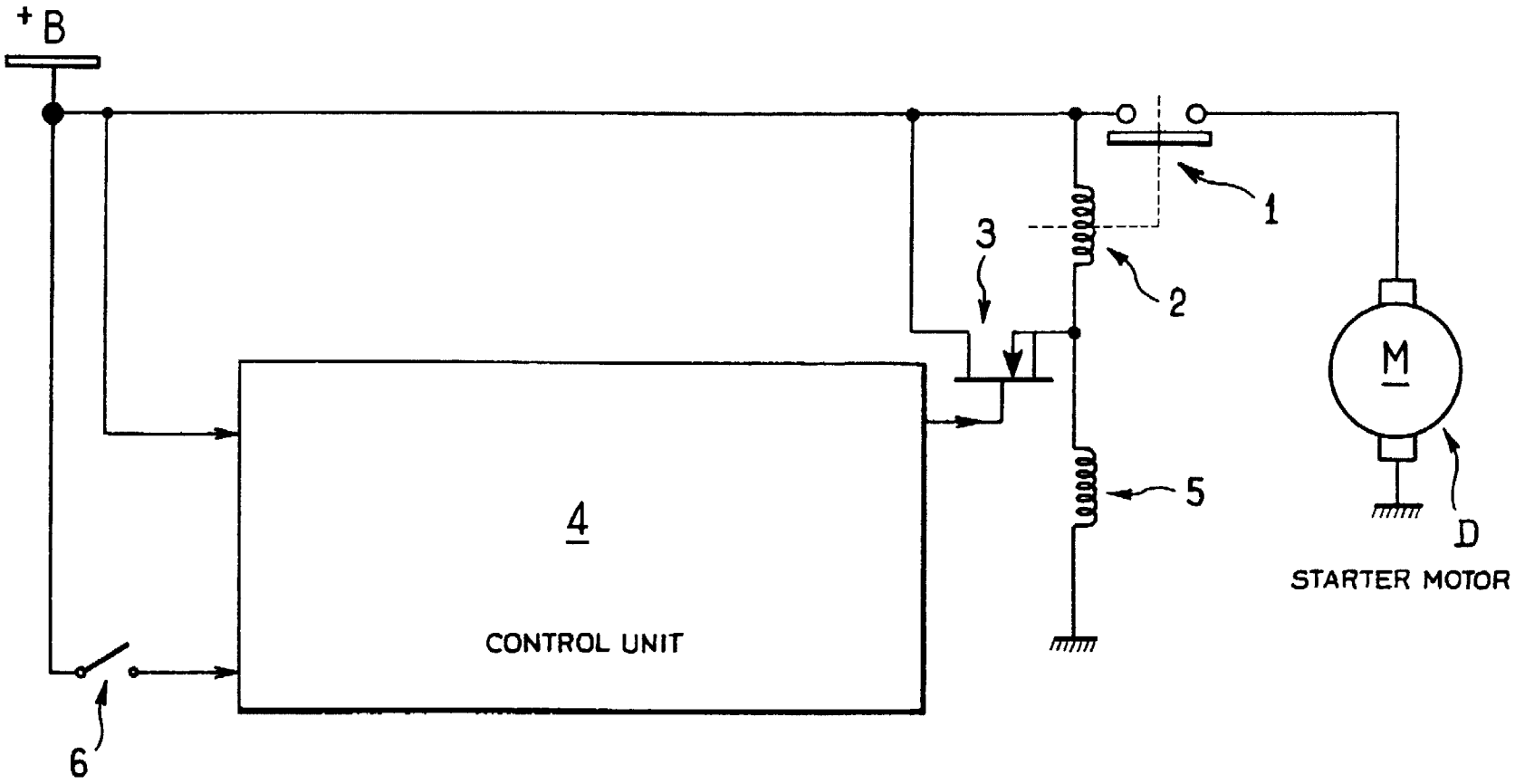
FIG. 1 is a circuit diagram of a cut-off control device for a starter, in one possible embodiment of the invention.

FIG. 1 shows a device for controlling the power supply to a starter D for the engine of a motor vehicle. The starter D includes an electric starter motor M which is connected between positive power supply terminal $B^+$ and ground. The terminal $B^+$ is connected to the battery voltage of the vehicle.

The control device comprises a contactor 1 which is connected between the positive power supply terminal $B^+$ and the starter D. The contactor 1 is a relay which is actuated by a relay coil 2. One end of the relay coil 2 is connected to the power supply terminal $B^+$. Its other end is connected firstly to the source of a MOSFET transistor 3, and secondly to a coil 5 which is connected to ground.

The drain of the transistor 3 is connected to the power supply terminal $B^+$. Its grid is connected to the output of a unit 4 from which it receives a voltage control signal. The transistor 3 could of course be replaced by any other suitable type of interruptor.

In the example shown in the drawings, the unit 4 generates the said control signal as a function, firstly of the waves, i.e. variations in amplitude, that occur in the voltage of the power supply terminal $B^+$, and secondly the position of the contactor, which is here the ignition switch actuated by the ignition key, and which is indicated diagrammatically at 6 in FIG. 1.

The signal processing function which is carried out by the control unit 4 will now be described in detail, with reference to FIG. 2 and FIGS. 3*a* to 3*e*.

Figure 3A:
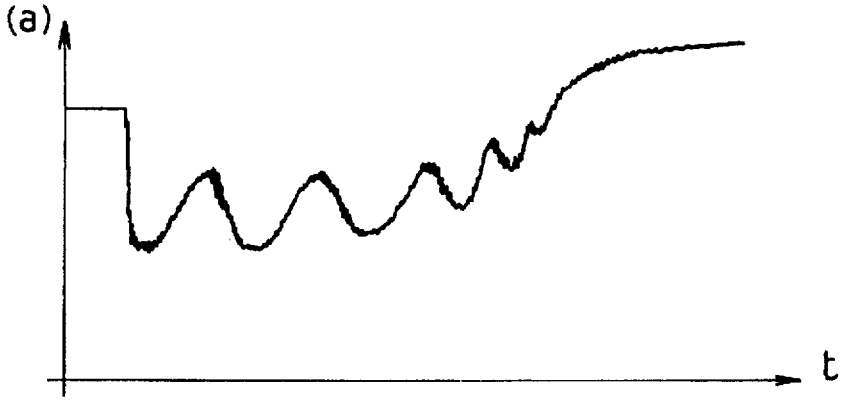
FIGS. 3*a* to 3*e* show various signals obtained at the output of the processing stages in the control means of FIG. 2.

During the starting phase of the engine, the input voltage to the control unit 4 (i.e. the voltage at the power supply terminal $B^+$) is of the type which is shown in FIG. 3*a*. So long as the engine is not yet running of its own accord (autonomously), this voltage is characterised by waves which occur at a frequency that increases with the engine speed. These waves disappear once the engine has started running autonomously.

Figure 2:
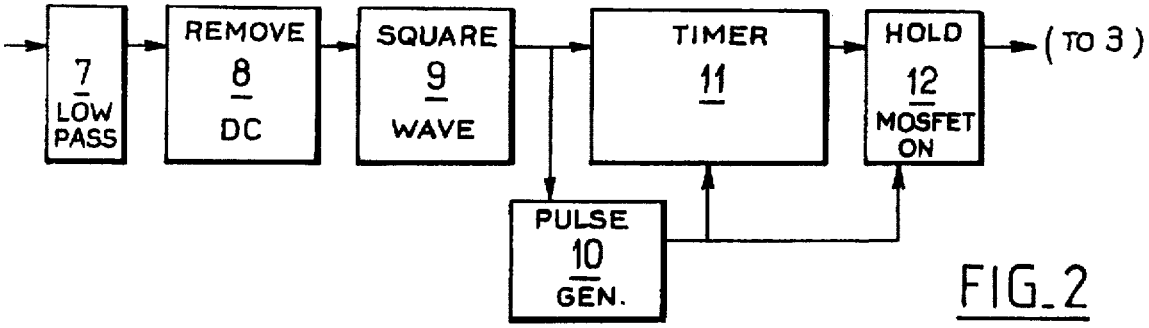
FIG. 2 is a synoptic block diagram, showing one possible embodiment of the control means in the device shown in FIG. 1.

As can be seen in FIG. 2, this signal is filtered by a low pass filter 7. Its unidirectional (direct current) component is then removed in a stage 8. The signal then obtained is of the type shown in FIG. 3*b*, which is the filtered alternating component of the signal seen in FIG. 3*a*.

Figure 3B:
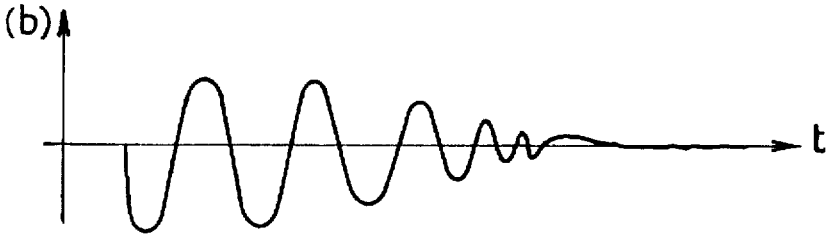
Figure 3C:
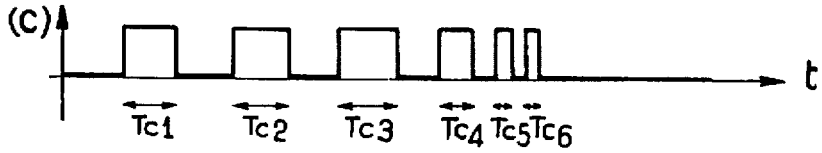

The stage 8 is followed by a stage 9 (see FIG. 2), in which the alternating signal of FIG. 3*b* is converted into a signal such as that shown in FIG. 3*c*, consisting of rectangular pulses. To this end, the stage 9 converts the negative pulses in the output signal from the stage 8 into positive pulses of constant amplitude, having the same duration as those negative pulses. The rectangular pulse signal thus obtained at the output of the stage 9 is passed, firstly to a pulse generator 10, and secondly to a timer 11. The pulse generator 10 produces the short pulses seen in FIG. 3*b* at the rising fronts of the pulses of its input signal shown in FIG. 3*c*. These short pulses reset at zero the time period generated by the timer 11.

Each time this period is reset at zero, the duration of the new time period Tsi generated is modified according to the duration Tci of the rectangular elementary signal at the output of the stage 9, so that it decreases from one pulse to another. The duration Tsi is chosen so as to be more than twice the duration Tci of the last elementary rectangular signal. Therefore, so long as the input signal to the control unit 4 is characterised by waves, a new wave occurs before the end of each time period, so that the timer is then reset at zero by the pulse which corresponds to this new wave.

The control unit 4 further includes means 12 for inhibiting blocking of the transistor 3, so long as the time period is maintained, in the way just described, by the waves in the input signal. The control voltage on the grid of the transistor 3 is at a level (i.e. the level 1 in FIG. 3*e*) at which it commands closing of the transistor 3, so that the coil 2 is short-circuited and the contactor 1 is closed.

Figure 3D:
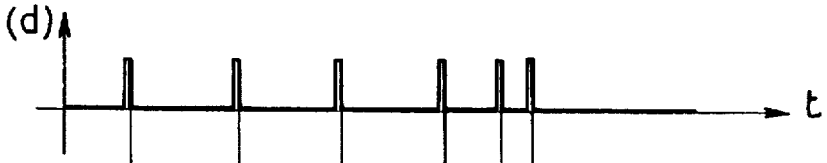
Figure 3E:
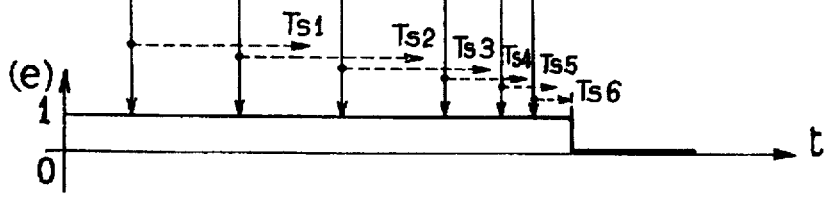

The blocking circuit which is constituted by the anti-blocking means 12 is also inhibited by the zeroing pulses of FIG. 3*d*. The starter is therefore not accidentally stopped when the timer 11 is reactivated. When the waves in FIG. 3*a* disappear, that is to say as soon as the engine has been properly started, the zeroing pulses of FIG. 3*d* also disappear and the timing operation terminates. Blocking of the transistor 3 is no longer inhibited, so that the signal, shown in FIG. 3*e*, is now at its zero level. The coil 2 is therefore no longer short circuited, and the contactor 1 is open. The starter is thus cut off.

With such a device, the delay between the starting of the engine and the cut-off of the starter is particularly short, because it is shorter than the duration of the last time period Tsi generated.

Reference is now made to FIG. 4, which shows one example of a possible circuit for the timer 11. It includes an integrated timing circuit 13 of a standard type, having an input 13*a* for voltage-governed time period control. A capacitor C is connected between this input 13*a* and ground. The capacitor C is charged by an elementary rectangular pulse signal through a diode D and a resistor R, the charge voltage Uc across the capacitor C being transmitted to the input 13*a*, optionally through an amplifier, not shown. The diode D prevents the capacitor C from discharging when the elementary rectangular pulse signal disappears.

The zeroing signal controls a transistor T which is connected between the capacitor C and ground. It causes the capacitor C to discharge rapidly through the transistor T.

The circuit 13 is thus governed by a voltage which corresponds to the mean value of the voltage Uc, and which is a function of the period Tc of the last rectangular elementary pulse signal received. This is illustrated in FIG. 5*c*, in which the voltage Uc is shown, with the rectangular pulse signal and the zeroing pulses being shown in FIGS. 5*a* and 5*b*. In FIG. 5*c*, the mean value of the voltage Uc is indicated in phantom lines, its magnitude being indicated by double arrows.

FIG. 4 also shows the time base input 13*b* of the timing circuit 13, and its control output 13*c*, which is maintained by a capacitor C1 at the control voltage for closing the transistor 3 so long as the timing operation has not been terminated. On termination of the timing operation, the circuit 13 discharges the capacitor C1.

Figure 6:
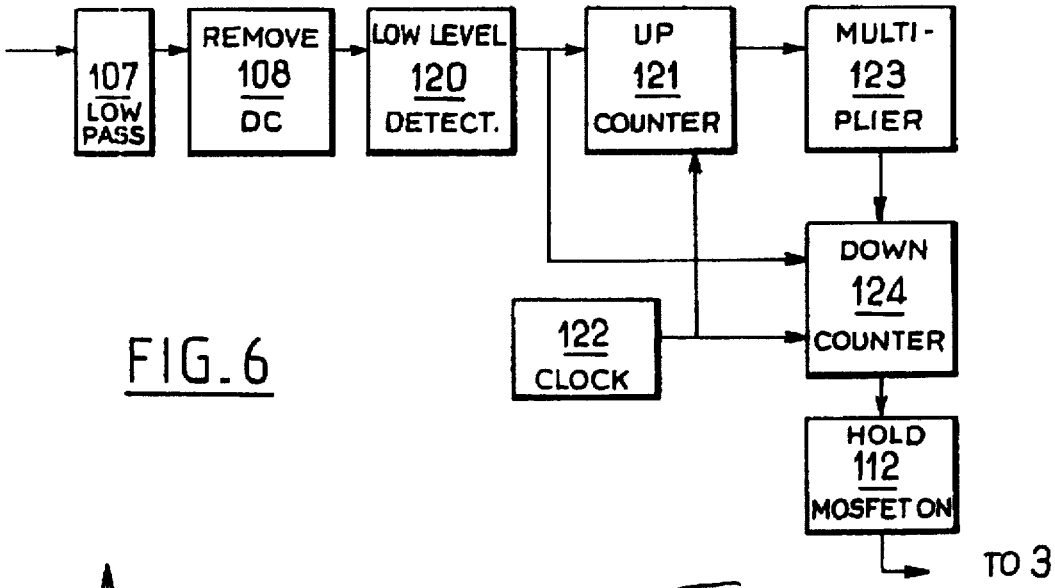
FIG. 6 is a synoptic diagram similar to that in FIG. 2, showing another possible embodiment of the control means in a cut-off control device in accordance with the invention.

Reference is now made to FIG. 6 and FIGS. 7*a* to 7*e*, showing another possible embodiment. In FIG. 6, those elements of FIG. 2 which appear again in FIG. 6 are given the same reference numerals with 100 added.

Figure 7A:
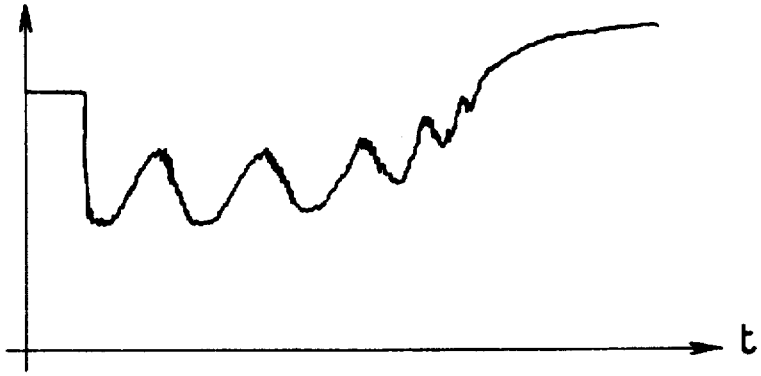
FIGS. 7*a* to 7*e* are diagrams similar to FIGS. 3*a* to 3*e* respectively, and show various signals obtained at the output of the processing stages in the control means shown in FIG. 6.
Figure 7B:
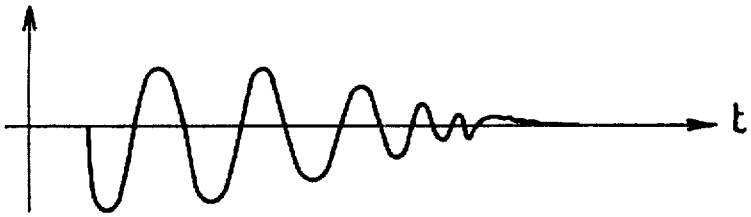
Figure 7C:
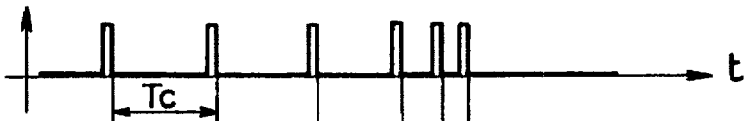
Figure 7D:
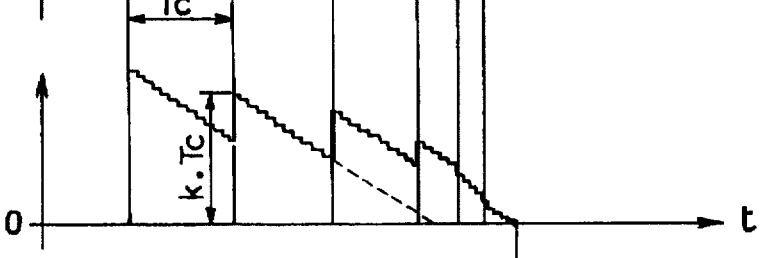

The input signal is the voltage taken from the power supply terminal $B^+$ for the electric motor (see FIG. 7*a*). This signal is taken to a low pass filter 107, which removes parasitic elements of the input signal. The next stage, 108, suppresses the unidirectional component of the filtered signal, and thereby produces the alternating signal shown in FIG. 7*b*. The output signal from the stage 108 is passed to a low level detector 120, which generates a succession of short pulses of calibrated period and amplitude. These pulses, which are shown in FIG. 7*c*, are passed to a counter 121, which also receives an incrementation signal from a clock timer 122. Each pulse characterises the end of a compression stroke in the engine which is being driven by the starter D.

The counter 121 is returned to zero by each pulse. The value which it attains before each reversion to zero caused by a pulse characterises the period between two successive compression strokes of the engine.

The pulses which are generated by the low level detector 120 are also transmitted, with the incrementation signal from the clock timer 122, to a reverse counter 124, which is reset on each new pulse. The value at which the reverse counter 124 is reset is a function of the period between the last two pulses measured by the counter 121.

In this particular embodiment, the contents Tc of the counter 121 are transmitted to a multiplier 123, which multiplies it by a value k which is greater than 1. The value at the output of the multiplier 123 is passed to the reverse counter 124. The monitoring period which is thus defined by the counting-down operation performed by the reverse counter 124 is therefore longer than the compression cycle of the engine of the vehicle.

Thus, until the engine has been fully started, the reverse counter 124 is reset, before the end of its monitoring periods, by the pulses which are successively generated by the waves in the input signal seen in FIG. 7*a*. Blocking of the transistor 3 is accordingly inhibited by the circuit 112, which passes the signal shown in FIG. 7*e*, at its level 1, to the transistor 3.

As soon as the engine is fully started, the starter is no longer transmitting any torque, so that the waves in the input signal of FIG. 7*a*, and the pulses, disappear. The absence of pulses during a monitoring period thereby signifies that the engine is running normally.

Figure 7E:
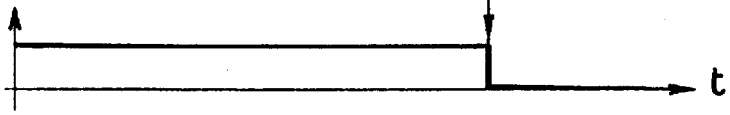

In consequence, when the value zero is reached by the reverse counter 124, the blocking inhibitor circuit 112 is controlled in such a way as no longer to inhibit the blocking of the control transistor 3, so that the signal in FIG. 7*e* changes to its zero level. The contactor 1 switches to the open state.

It will be noted that, since the system works with monitoring periods that are longer than the periods of the compression cycle of the engine, this avoids any incorrect and premature cessation of the starter due to any irregularities in the speed of rotation of the engine.

For proper operation of the system, the reverse counter 124 is reset before the counter 121 is returned to zero. For this purpose, a retarder circuit may be connected on the zeroing input of the counter 121. In another version, it is also possible to use the rising front of the pulses for resetting the reverse counter 124, and their falling front for zeroing the counter 121.

Starting of the system calls for either inhibition of the blocking circuit for the transistor 3 during at least one compression stroke, or initial loading of a value into the reverse counter 124.

Other embodiments may also be envisaged. In the second embodiment described above, the multiplier may be omitted if the counting-down operation by the reverse counter is performed at a frequency lower than the counting frequency. For this purpose, a divider circuit, for example with a bi-stable flip-flop, may be interposed between the clock timer 122 and the reverse counter 124.

In general terms, in place of the voltage signal available across the starter or the battery, the signal which is processed by the control unit 4 may be a signal corresponding to the intensity of the current flowing through the starter D.

This intensity signal may be obtained by measurement of the voltage drop on the conductive elements, having an essentially resistive (ohmic) characteristic, which are in series with the starter, for example power contacts of the contactor 11, the cable linking the contactor 11 and the starter D, the ground return cable of the starter D, and the power supply cable between the battery and the starter.

In another version, this current intensity may be obtained by measuring variations in voltage induced in a measuring coil through which one of the above mentioned conductive elements passes.

In yet another version, the pulses in the signals shown in FIG. 3*d* or FIG. 7*c* may be generated by a detector for detecting when the alternating component of the filtered signal goes to zero. This detector then takes the place of the low level or high level detector.

Again, driving of the engine by the starter may be characterised by the differential (rate of change) of the power supply voltage or current. During the compression strokes when the starter is driving the engine, the differential of the voltage is negative and the differential of the current is positive. A monostable flip-flop circuit enables a signal to be started, either at the beginning or at the end of the period for which the engine is driven by the starter.

As will have been understood, a timing operation of variable period, of the general type exemplified by the operations described above, enables the starter to be matched to the behaviour of the engine while cutting it out at the earliest possible instant, without however running the risk of an inappropriate or unwanted command being issued for stopping the starter.

At the end of the phase in which the engine is driven by the starter, i.e. at the instant when the engine starts to rotate by itself, the speed is of the order of 300 to 400 revolutions per minute, with a period between two successive pulses of 0.07 to 0.1 second.

At the beginning of the starting operation, and especially when the engine is being started cold, the speed may be only about 70 revolutions per minute, with a period of 0.43 second between two successive pulses.

If a fixed time period, set at 0.1 second, is used, the command for stopping the starter would be given before the first rotation of the engine, because no zeroing signal would appear before the timer had switched.

A fixed time period set at 0.43 second would enable the engine to be started cold, but the order for stopping the starter would be very late, and could even act, especially when the engine is hot, at high engine speeds of the order of 1000 to 1500 revolutions per minute, with a starter pinion speed of 12000 to 20000 revolutions per minute. At these speeds, the starter is particularly noisy, and undergoes accelerated wear. In addition, it is essential to provide a free wheel.

It will also be noted that, with the timing operation proposed by the invention, starter cut-off is independent of the characteristics of the engine itself, and in particular the number of cylinders, fuel injection and ignition features, the state of wear or tuning of the engine, battery characteristics, and so forth.

In addition, the proposed arrangement has the advantage of being entirely autonomous, and it does not call for any additional electrical wiring when being fitted on the vehicle.

The assembly which consists of a control device of the general type described herein, and its alternator, is in practice interchangeable with a conventional starter system.

It will also be noted that the current in the ignition switch 6 is very low, being only a few milliamperes instead of the usual values of 10 to 40 A. As a result of this, the starter according to the invention can be treated as a low current control means, which enables numerous variations in the method of control of the starter to be envisaged. Some examples of these are control by entering codes, control by means of the accelerator pedal, and so on.

What is claimed is:

1. A method of controlling cut-off of a motor vehicle starter, comprising the steps of supplying electrical power to the said starter, taking a signal corresponding to a parameter of the said power, the parameter being selected from power supply voltage and power supply current, detecting successive waves defined by a varying amplitude of the said parameter, and stopping the starter when the said waves disappear, the method further comprising, at each new wave, generating a monitoring period having a duration which decreases as the frequency of the said waves increases, and detecting the absence of any said new wave in the final said monitoring period, the starter being stopped in response to the said absence of a wave.

2. A device for controlling cut-off of a motor vehicle starter, comprising means for detecting waves defined by a variation in amplitude of a signal corresponding to a parameter of the electrical power supplied to the starter, the said parameter being selected from power supply voltage and power supply current, together with means for commanding stopping of the starter once said waves are absent, wherein the device further includes means for generating, at each new said wave, a monitoring period having a duration which decreases as the frequency of the said waves increases, the means for stopping the starter being responsive to the absence of a said new wave in the final said monitoring period, whereby to stop the starter in response to the said absence.

3. A device according to claim 2, wherein the means for detecting the said waves comprise pulse generating means for generating, at each new said wave, a zeroing pulse for zeroing the monitoring period.

4. A device according to claim 3, further including processing means for converting the said waves to a rectangular signal of constant amplitude, having the same period as the said waves, the means for generating the said monitoring periods being adapted to define the latter as a function of the duration of an elementary pulse of the said rectangular signal.

5. A device according to claim 4, further including a timer having a voltage-controlled period and a control input, a capacitor connected so as to receive the said rectangular signal, the said control input of the timer being controlled by the voltage from the said capacitor, and the device further including means for discharging the said capacitor at each zeroing pulse.

6. A device according to claim 5, further including a counter arranged to be reset at each new zeroing pulse, the said means for generating monitoring periods being adapted to define the duration of each monitoring period as a function of the value of the said counter on each new pulse.

7. A device according to claim 6, further including a reverse counter connected with the said counter and adapted to be reset to a value which is a function of the said value of the counter on receipt of each new zeroing pulse.

8. A device according to claim 7, further including a clock timer for giving a clock signal, and having an output connected to the counter and to the reverse counter, whereby the counter and reverse counter are controllable by a common signal from the clock timer, the resetting value of the reverse timer being selected so as to be greater than the said counter value.

9. A device according to claim 7, wherein the reverse counter is adapted to be reset, at each zeroing pulse, before the said counter is reset.

* * * * *

UNITED STATES PATENT AND TRADEMARK OFFICE

CERTIFICATE OF CORRECTION

PATENT NO. : 5,743,227

DATED : April 28, 1998

INVENTOR(S) : Jacquet et al.

It is certified that error appears in the above-identified patent and that said Letters Patent is hereby corrected as shown below:

Column 8, Claim 6, line 1, delete "5" and substitute --3--.

Signed and Sealed this

Sixteenth Day of March, 1999

*Attest:*

*Attesting Officer*

Q. TODD DICKINSON

*Acting Commissioner of Patents and Trademarks*